US008727396B2

(12) United States Patent
Bui

(10) Patent No.: US 8,727,396 B2
(45) Date of Patent: May 20, 2014

(54) SIX-WAY ADJUSTABLE PUSH LATCH

(75) Inventor: Jeanette Vy Bui, Irvine, CA (US)

(73) Assignee: Price Pfister, Inc., Foothill Ranch, CA (US)

( * ) Notice: Subject to any disclaimer, the term of this patent is extended or adjusted under 35 U.S.C. 154(b) by 0 days.

(21) Appl. No.: 13/205,000

(22) Filed: Aug. 8, 2011

(65) Prior Publication Data

US 2013/0038073 A1 Feb. 14, 2013

(51) Int. Cl.
*E05C 1/12* (2006.01)

(52) U.S. Cl.
USPC ..... 292/169.23

(58) Field of Classification Search
CPC ..... E05B 55/005; E05B 63/06
USPC ..... 292/1.5, 163, 165, 173, 169, 169.23, 292/337, 336.3, 336.5, DIG. 60; 70/449, 70/461
See application file for complete search history.

(56) References Cited

U.S. PATENT DOCUMENTS

| | | | | | |
|---|---|---|---|---|---|
| 1,661,454 | A | * | 3/1928 | Wilson | 70/448 |
| 4,372,594 | A | | 2/1983 | Gater | |
| 4,593,542 | A | * | 6/1986 | Rotondi et al. | 70/134 |
| 4,602,490 | A | | 7/1986 | Glass et al. | |
| 4,623,174 | A | * | 11/1986 | Trull et al. | 292/1.5 |
| 4,653,787 | A | | 3/1987 | Fang | |
| 4,656,849 | A | * | 4/1987 | Rotondi et al. | 70/134 |
| 4,664,433 | A | | 5/1987 | Solovieff | |
| 4,720,127 | A | | 1/1988 | Doolan | |
| 5,364,138 | A | | 11/1994 | Dietrich et al. | |
| 6,419,288 | B1 | | 7/2002 | Wheatland | |
| 6,536,812 | B1 | * | 3/2003 | Winardi | 292/1.5 |
| 7,695,032 | B2 | * | 4/2010 | Bodily | 292/337 |
| 2002/0008390 | A1 | * | 1/2002 | Markbreit | 292/337 |
| 2002/0109360 | A1 | * | 8/2002 | Wheatland | 292/169 |
| 2002/0116964 | A1 | * | 8/2002 | Koskela et al. | 70/224 |
| 2004/0251697 | A1 | * | 12/2004 | Chiang | 292/337 |
| 2005/0006912 | A1 | | 1/2005 | Huang | |
| 2006/0006659 | A1 | * | 1/2006 | Yuan | 292/1.5 |
| 2006/0186672 | A1 | * | 8/2006 | Levine | 292/1.5 |
| 2006/0208509 | A1 | * | 9/2006 | Bodily | 292/337 |
| 2007/0205606 | A1 | * | 9/2007 | Shen | 292/1.5 |
| 2007/0290514 | A1 | | 12/2007 | Halac | |
| 2009/0152875 | A1 | * | 6/2009 | Gray et al. | 292/1.5 |

OTHER PUBLICATIONS

International Search Report; Nov. 2, 2012.

* cited by examiner

*Primary Examiner* — Kristina Fulton
*Assistant Examiner* — Nathan Cumar
(74) *Attorney, Agent, or Firm* — Barnes & Thornburg LLP

(57) ABSTRACT

A latch assembly for insertion into an edge of a door and adjustable for actuation by a half-round spindle at either a first backset or a second backset. The latch has an inner casing non-rotatably received within an outer casing and slideable along an axis. The inner casing is provided with a transverse void substantially perpendicular to the sliding axis and is slideable between a first position in which the transverse void is aligned at the first backset and a second position is which the transverse void is aligned at the second backset. A slide within the casing is, without adjustment, engageable by the half-round spindle at either backset. A cam is rotatably mounted within the casing and engaged to the slide and to a bolt also within the casing. The bolt is slideably retractable into the casing by rotation of the cam in response to sliding of the slide. A spring biases the bolt to an extended position extend out from the casing.

22 Claims, 5 Drawing Sheets

SIX-WAY ADJUSTABLE PUSH LATCH

BACKGROUND OF THE INVENTION

1. Field of the invention

The present invention relates generally to lock and latch mechanisms and more particularly to latch mechanisms that are adjustable to accommodate differing door hardware backset dimensions.

2. Description of the Background

Entry doors on and in commercial and residential structures are commonly provided with a latching mechanism to a closed position when not locked, and/or a locking mechanism for securing them in the closed positions. In either case the retention and securing functions are accomplished by a bolt extending from the door and into the door frame to prevent movement. The bolt may be a spring actuated asymmetric latch bolt having a sloped face that is forced into the casing by contact with the strike plate to permit the door to latch closed on its own. Alternatively, a lockbolt with no sloped face may be manually extended or retracted. Such doors are equipped with hardware on their interior and exterior surfaces, typically a knob or lever rotatable on a spindle, to actuate the mechanism(s) and retract the bolt into the door and thereby allow the door to swing open. A number of different lock and latch mechanisms are available but the type known as tubular, or "bored through" locksets have become commonplace in residential and other applications. Tubular handlesets are designed to be installed in an industry standard pattern of holes drilled in an edge and face of the door. The distance from the latch edge of the door to the axis of rotation of the hardware spindle is referred to as the backset and dictates the position of the hole drilled through the face of the door. Two dimensions are standard in the industry: 2⅜ inches or 2¾ inches. To avoid the expense and complication of developing and offering separate lock and latch mechanisms for each backset dimension, it would be advantageous to provide a single mechanism capable of accommodating various backset dimensions.

Adjustable backset door latches have been developed which utilize various mechanisms to vary the distance between the door edge and the rotational axis of the latch knob, including slot and pin arrangements such as shown and described in U.S. Pat. Nos. 1,661,454 and 4,372,594, spring-loaded pins such as shown and described in U.S. Pat. Nos. 4,653,787 and 4,602,490, and push-and-twist arrangements such as U.S. Publication No. 20070290514. These devices require adjustment of multiple components when being adjusted from one backset to another. Specifically, when adjusting from one backset to another, all known adjustable backset door latches require at least two or three components to be moved to a new position. This takes significant effort and time. Moreover, once the adjustable backset door latch has been adjusted and installed in a door, it cannot be readjusted. Rather, it must be removed so that those two or three internal components can be moved to their new positions.

It would be advantageous to provide a mechanism that requires adjustment of a single component to adjust from one backset to another, can be adjusted in place even after initial installation on a door without complete removal, and which is simple to adjust and operate, efficient and inexpensive to manufacture, and durable and reliable for longtime use.

SUMMARY OF THE INVENTION

It is, therefore, the primary object of the present invention to provide an improved adjustable backset lock or latch (collectively latch) mechanism which can accommodate multiple backset dimensions with minimal adjustment and/or specifically which can accommodate backsets of 2⅜ inches (60 mm) and 2¾ inches (70 mm).

It is another object to provide a such a mechanism that is simple to adjust in order to accommodate the variable backset dimensions It is another object to provide a such a mechanism that has a minimum of moving parts so as to be efficient and inexpensive to manufacture and reliable to operate.

It is another object to provide an adjustable backset door latch that can be readjusted even after initial adjustment and installation, without removal, while still installed in the door.

In accordance with the foregoing objects, disclosed is a latch assembly for insertion into an edge of a door and adjustable for actuation by a half-round spindle at either a first backset or a second backset. The latch has an inner casing slideably received within an outer casing. The outer casing is provided with a transverse void substantially perpendicular to the sliding axis. The inner casing is slideable between a first position in which the transverse void is aligned at the first backset and a second position is which the transverse void is aligned at the second backset. A slide within the casing is, without adjustment, engageable by the half-round spindle at either backset. A cam is rotatably mounted within the casing and engaged to the slide and to a bolt also slideably received within the casing. The bolt is slideably retractable into the casing by rotation of the cam in response to sliding of the slide. The slide is slideable within the casing in response to rotation of the half-round spindle. A spring biases the bolt to an extended position extend out from the casing and returns the slide to a home position of release of the knob. One or more detents in the inner and outer casing register the inner casing at the proper position relative to the outer casing to ensure proper alignment of the transverse void at one of the two backset dimensions.

BRIEF DESCRIPTION OF THE DRAWINGS

The objects, features, and advantages of the present invention will become apparent from the following detailed description of the preferred embodiments and certain modifications thereof when taken together with the accompanying drawings in which like numbers represent like items throughout and in which.

DETAILED DESCRIPTION OF THE PREFERRED EMBODIMENT

Figure 1:
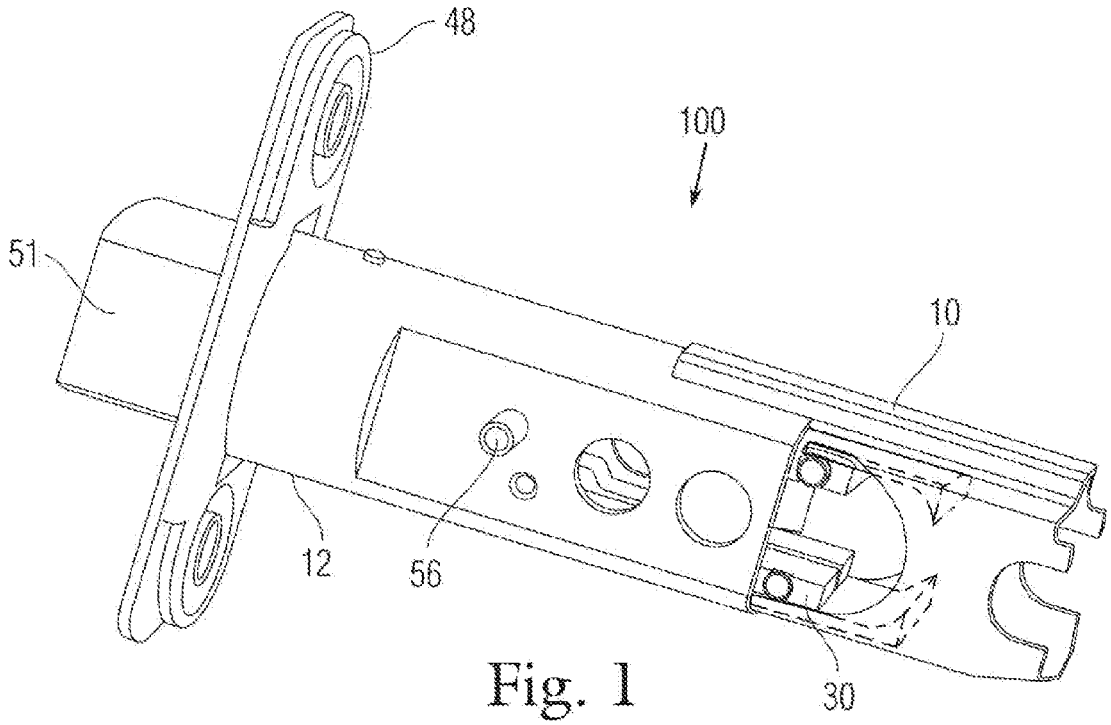
FIG. 1 is a perspective view a latch according to the present invention.

For the purposes of promoting an understanding of the principles of the invention, reference will now be made to the exemplary embodiment illustrated in the drawings and described below. The embodiment disclosed is not intended to be exhaustive or limit the invention to the precise form disclosed in the following detailed description. Rather, the embodiment is chosen and described so that others skilled in the art may utilize its teachings. It will be understood that the invention includes any alterations and modifications in the illustrated device, the methods of operation, and further applications of the principles of the invention which would normally occur to one skilled in the art to which the invention relates.

Directional terms such as left, right, up, down, top, bottom, inside, outside, inner, outer and the like are used for illustration and are not intended to be limiting. Additionally, although the present invention is disclosed in terms of a latch mechanism, a lock assembly is also contemplated. Consequently references to latching such as "latch casing" or "latch bolt" shall include their locking counterparts unless otherwise specified.

Figure 3:
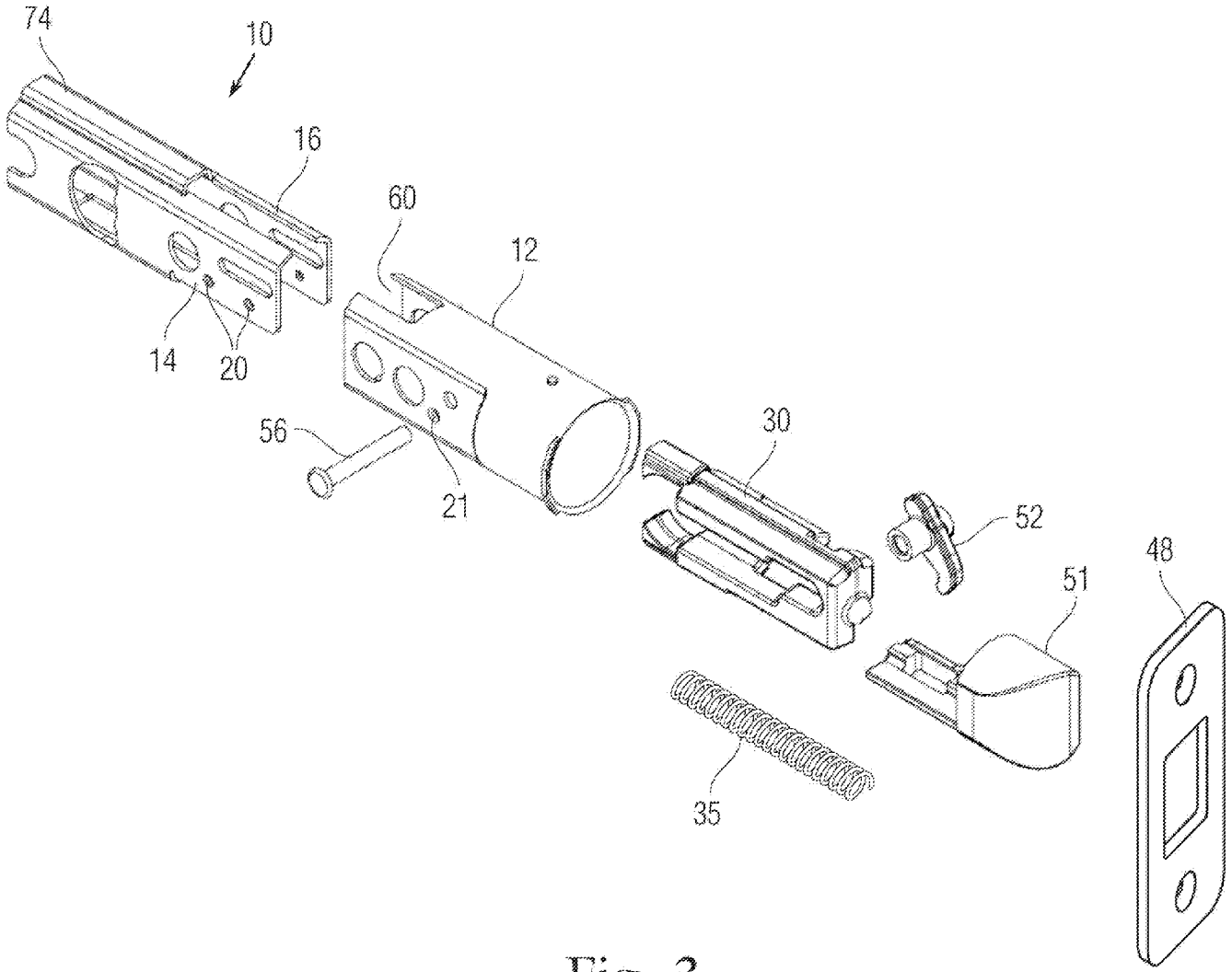
FIG. 3 is an exploded view of a latch according to the present invention.

With reference to FIGS. 1 and 3, a latch assembly 100 according to the present invention is depicted. The latch assembly includes a latch casing composed of an inner case 10 and an outer case 12.

Figure 7:
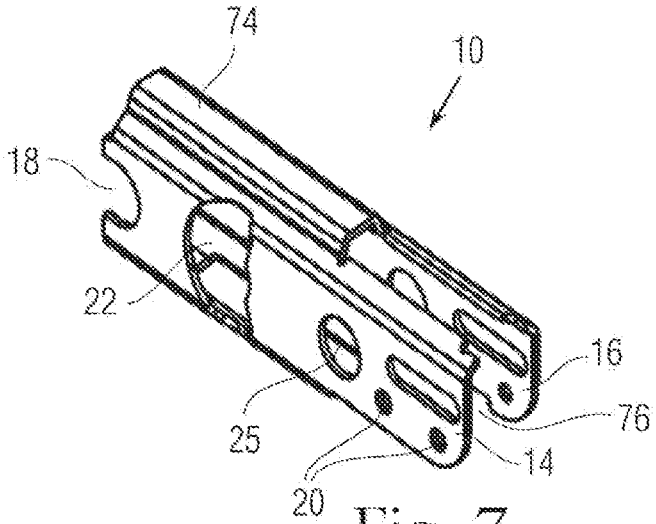
FIG. 7 is a perspective view of an inner case of a latch according to the present invention.

Referring now to FIG. 7, the inner case 10 is a generally tubular member open at both ends and defining an internal longitudinal void along its axis. The tubular inner case 10 comprises left and right sidewalls 14, 16 which are typically (but not necessarily) mirror images of one another and which are provided with a variety of surface features as will be described. The left and right sidewalls 14 and 16 are joined at their top and bottom edges for at least a portion of their lengths to complete the tubular form of the element.

Figure 8:
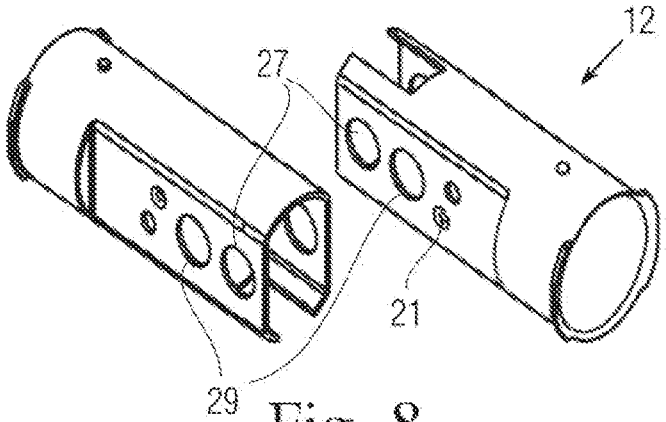
FIG. 8 is opposing perspective views of an outer case of a latch according to the present invention.

With further reference to FIG. 8, the outer casing 12 is a similarly tubular member with various surface features as will be described. The outer casing 12 is open at both ends and when inserted into a door during installation is aligned with an edge of the door. Aligned, in this context refers to location at a fixed point in relative proximity to the edge.

Figure 2:
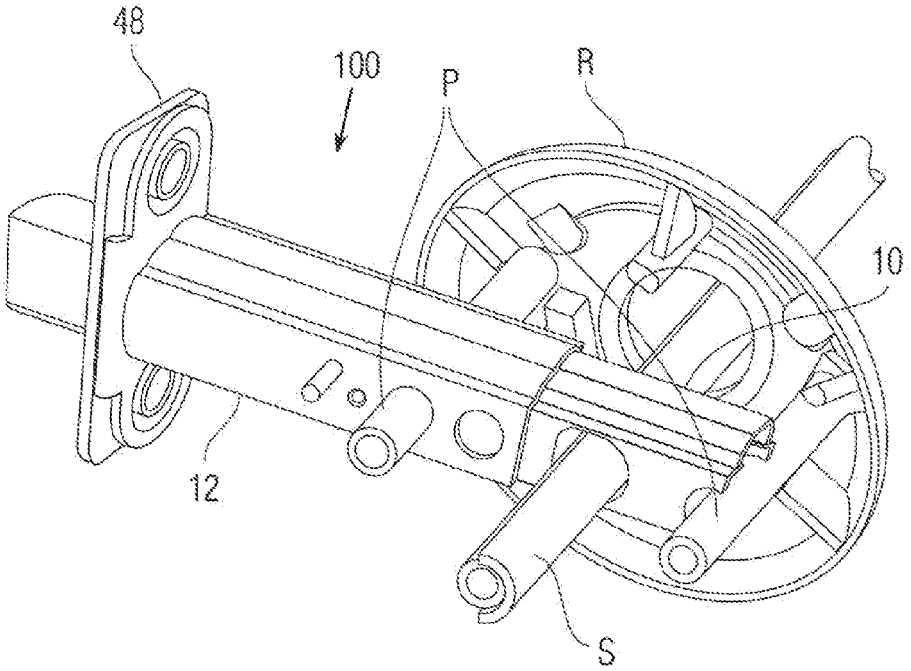
FIG. 2 is a perspective view a latch according to the present invention in conjunction with a rose insert of a door knob assembly.

Referring back to FIGS. 1-2, a latch face plate 48 is commonly provided to align and secure the latch casing (by its inner case 10) to the edge of the door. The outer casing 12 is sized and cooperatively formed to receive a portion of the length of inner casing 10 within the longitudinal void at its center. The inner casing 10 is axially slideable within the outer casing 12. By "cooperatively formed" it is meant that the shape of the outer casing 12 conforms to that of the inner casing 10 as needed to permit longitudinal sliding, and preferably to prevent relative rotation.

As seen in FIG. 7, in order to limit the sliding of the inner casing 10 relative to the outer casing 12 and to accurately and precisely position the inner and outer casings 10, 12 relative to one another as necessary to accommodate two or more latch backset dimensions, the left and right sidewalls 14, 16 of inner casing 10 are both provided with two recesses 20 that are aligned with one another along an axis parallel to the longitudinal axis of the casing. The recesses 20 are preferably provided as holes punched through the sidewalls 14, 16 of the outer casing 12 but may alternately be provided in the form of indentations, groves or ridges similarly configured. The recesses 20 of each sidewall 14, 16 may be connected by a narrow channel or slot (the term channel being inclusive thereof) in or through the surface of the sidewall to facilitate sliding of opposing protrusions or dimples 21 (FIG. 8) cooperatively positioned on the inside surface of the outer casing 12.

Each dimple 21 is received in a corresponding recess 20 when the inner casing 10 is received within the outer casing 12. The dimples 21 may be formed by punching through or otherwise applying a force to the outside of the outer casing 12 to cause the dimple 21 to be raised on the inner surface.

As seen in FIG. 3, when the inner casing 10 is received within the outer casing 12 so as to accommodate a first backset dimension, the dimples 21 of the outer casing 12 are each received within a first hole 20 in left and right sidewalls 14, 16 of the inner casing 10. Seating of the dimples 21 in the holes 20 serves to positively register the two casings 10, 12 to accommodate the first backset dimension and serves as a detent to prevent unwanted sliding of the casings 10, 12 during installation. If it is desired to adjust the latch to accommodate the second backset dimension the inner casing 10 is slid along the axis of the outer casing 12 (by applying sufficient force to overcome the detent effect of the dimple in the first hole 20) until the dimples 21 are aligned with and received in the holes 20. The holes 20 then serve to positively register the two casings 10, 12 properly to accommodate the second backset dimension, and also inhibits unintended sliding. No other adjustment to the latch mechanism is required to adjust from one backset dimension to another. To maintain alignment between the dimple 21 and holes 20 (as well as the alignment of other elements as will be described) it is important that the inner case 10 be limited to sliding relative to the outer casing 12 and prevented from relative rotation. Although there are two industry standard backset dimensions, it is noted that a third or more additional backset dimensions could be accommodated by the present invention in this way.

A bolt assembly resides within the casings 10, 12. As seen in FIG. 3, the bolt assembly includes the bolt 51, a cam 52 and a slide 30 which make up the operative elements that engage the half-round spindle of the door knob and retract the bolt 51 to release the door. As seen in the cutaway of FIG. 1, the slide 30 is slideably received within the casings 10, 12 such that the door knob half-round spindle S (FIG. 2) must pass though the casings 10, 12 to engage the slide 30 and ultimately retract the bolt 51. The stems P of rose liner R of the knob assembly must past through the casings 10, 12 to secure the knob assembly to the face of the door and must do so without impeding operation of the latch at either backset dimension. To accomplish this, the inner casing 10 is provided with aperture pairs 18, 25 (FIG. 7) in both the left and right sidewalls 14, 16 to permit the stems P to pass from one side of the door to the other. A larger aperture pair 22 is similarly provided between the stem aperture pairs 18, 25 and defines a transverse void through the inner casing 10 generally perpendicular to the axis of the casing 10 that permits the half-round spindle S (FIG. 2) to pass through joining knobs on the inside and outside of the door and engaging the slide 30, as will be described. Because the position of the inner slide 30 is adjusted when the backset is altered (i.e. when the position of the half-round spindle S is shifted), the relative position of the stems P and half-round spindle S with respect to the aperture pairs 18, 25, 22 of the inner case 10 is constant and only a single aperture pair through the inner case 10 is required for each stem P and the half-round spindle S.

The outer casing 12, however, is fixed to the edge of the door by the latch face plate 48 and does not move when the backset is altered. Consequently, the position of the stems P relative to the outer casing is not constant and two sets of holes 27, 29 (FIG. 8) are required to accommodate penetration of the forward or edge-most stem P at each of the two backset dimensions. When the inner casing 10 is slid within the outer casing 12 such that the dimple 21 is positioned in the first hole 20, apertures 25 (inner casing) and 27 (outer casing) will align to permit the stems P to pass through the casing. When the dimple 21 is positioned in the second hole 20, apertures 25 (inner casing) and 29 (outer casing) will align to permit the stem P to pass through the casings 10, 12. In this way the stem P can pass through the casings at either backset dimensions. Neither of the other apertures 18, 22 in the inner casing 10 overlap with the outer casing 12 at either backset position and thus do not require multiple apertures through the outer casing 12. It should be noted that individual holes 27, 29 could joined to form a single hole with the same effect.

Referring to FIG. 3, the slide 30 is provided to engage the half-round spindle S at one end and the bolt 51 (via a cam 52) at the other end to retract the bolt 51 on rotation of the half-round spindle S. In order to be slideable within the casings 10, 12 the slide 30 is shaped to engage the half-round spindle S and the cam 52 without interfering with the various other elements extending laterally through the casings 10, 12, leaving slide 30 slideable within the casings 10, 12.

Figure 9:
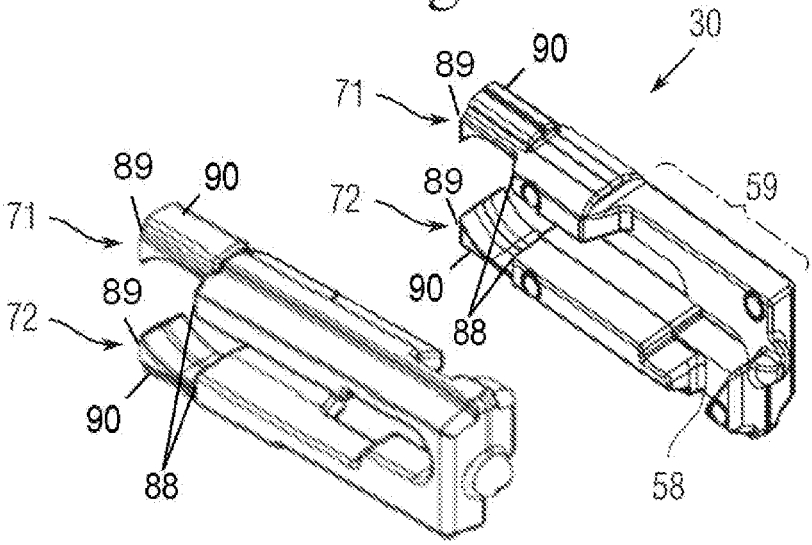
FIG. 9 is opposing perspective views of a slide of a latch according to the present invention.

FIG. 9 illustrates a preferred embodiment of slide 30 provided in the form of a carriage having an upper arm 71 and a lower arm 72, the arms being joined at their forward, proximal ends to leave the longitudinal space between them largely void to clear the stems P and half-round spindle S as it slides. With additional reference to FIG. 4 (section view of a latch in first backset condition), the distal ends of each arm 71, 72 are provided contact surfaces 88 for engagement by the half-round H of the spindle S when the half-round spindle is at the first backset dimension.

Figure 5:
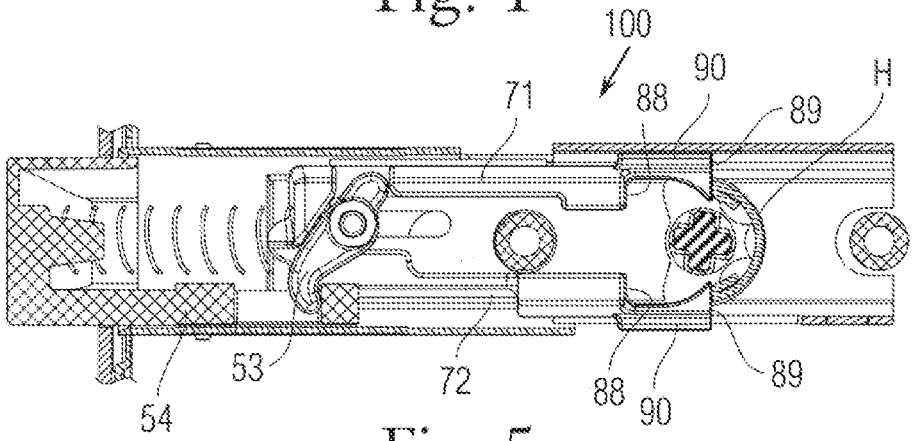
FIG. 5 is a section view of a latch according to the present invention in a second backset condition.

As seen in FIGS. 5 and 9, a slide extension 90 extends each upper and lower arm 71, 72 a distance equal to the difference between the backset dimensions and provides a second upper and lower contact surface 89 for engagement by the half-round H of the spindle S when the half-round spindle is at the second backset dimension. Providing contact surfaces 88, 89 on the upper and lower arms 71, 72 enables actuation of the slide by rotation of the half-round spindle in either direction. Providing separate contact surfaces 88, 89 for each backset dimension enables the half-round spindle S to engage and actuate the slide 30 at either backset without the need to adjust the slide 30.

Figure 6:
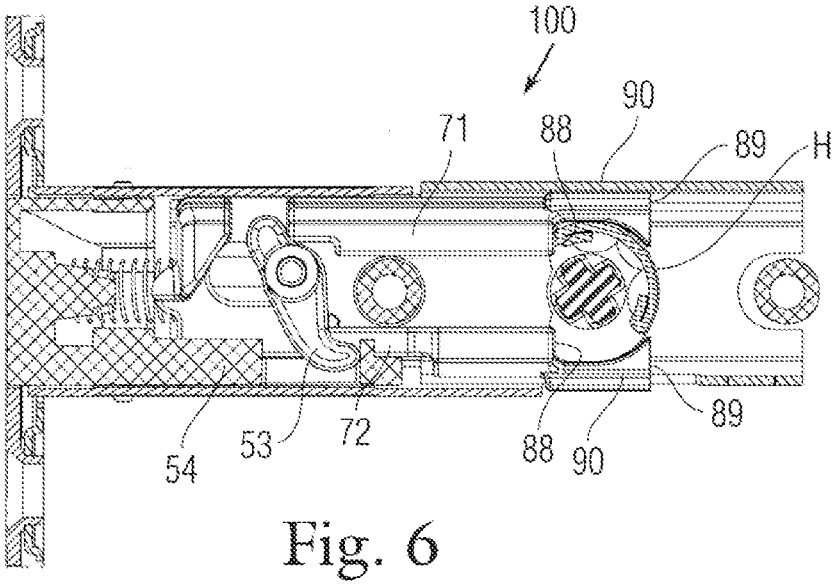
FIG. 6 is section view of a of a latch according to the present invention in a first backset condition with the bolt retracted.

Because the slide extensions 90 extend past the half-round spindle S when the half-round spindle is at the first backset dimension it is necessary to form the inner edges of the slide extensions 90 so as not to contact or engage the half-round spindle S when the half-round spindle is set at the first backset dimension and rotated such that the slide 30 is fully advanced, as seen in FIG. 6. In the depicted embodiment, the inner edges of the slide extensions 90 are arcuate to match the half-round form H of the spindle S while still presenting a sufficiently large and strong second contact surface 89 to engage the half-round spindle when at the second backset dimension. Note that removing material from the inside of the slide arm extensions 90 to ensure clearance around the half-round spindle may weaken the junction at the main portions of the slide arms (i.e. at the contact surfaces 88). To ensure strength between the slide arms 71, 72 and the slide arm extensions 90 the overall thickness of the slide arm extensions 90 may be increased. In this case, in order to accommodate this thickness, the top and bottom surfaces of the inner casing 10 must be removed or relieved.

As seen in FIG. 3, the top surface of the inner casing 10 is preferably relieved by forming a longitudinal track 74 in the casing joining the left and right sidewalls 14, 16. The track 74 is further preferably formed to project past the outside edge of the outer casing 12 and receives the slide extension 90 of the upper slide arm 71. The track 74 is also itself received in a slot 60 in the outer casing.

As seen in FIG. 7, the bottom surface of the inner casing is preferably relieved by a longitudinal slot 76 in the casing and receives the slide extension 90 of the lower slide arm 72. In addition to accommodating the thickened dimensions of the slide arm extensions 90, engagement of the slide arm extensions 90 in the longitudinal track 74 and slot 76 of the top and bottom of the inner casing 10, respectively serves as a guide to and limit relative longitudinal sliding of the slide 30 within the casing 10 for smooth operation and also prevents unwanted relative rotation. In the depicted embodiment, relative rotation is further eliminated by engagement of the flat sidewalls 14, 16 of the inner casing 10 within the flat sides of the outer casing 12 as well as engagement of the flat sides of the slide 30 with the flat sidewalls 14, 16 of the inner casing 10.

Figure 4:
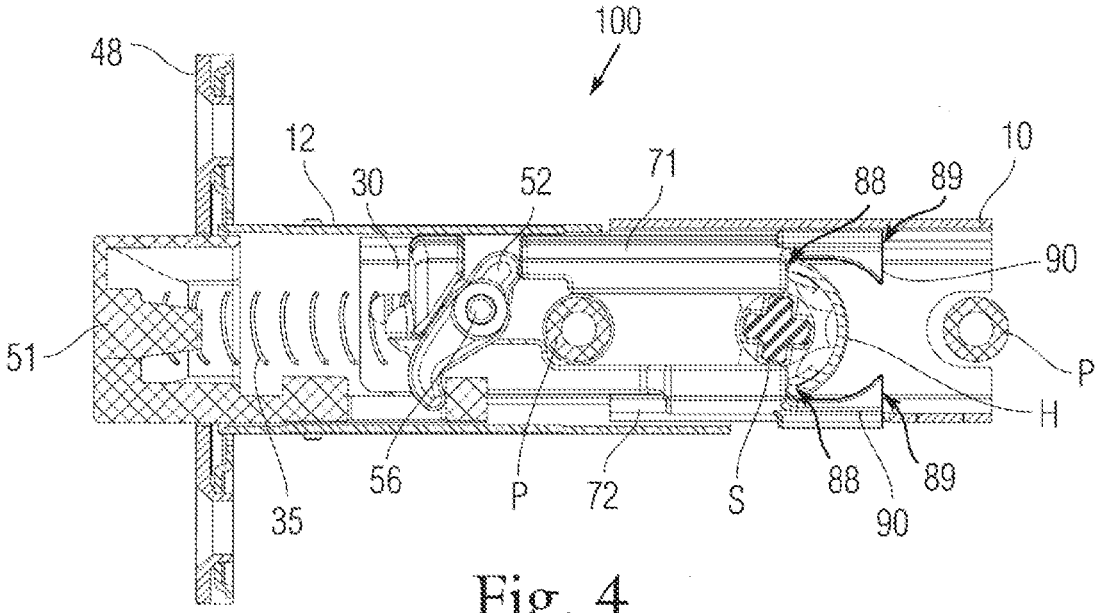
FIG. 4 is a section view of a latch according to the present invention in a first backset condition.

With renewed reference to FIGS. 4-6, the proximal end of the slide 30 is formed to engage the cam 52 and to bypass the tail 54 of the bolt 51 when the bolt is retracted. The cam 52 is pivotably fixed within the casing by a rivet 56 though the cam 52 and the outer casing 12. Like the stem P and half-round spindle S, the rivet 56 passes through the casing between the arms 71, 72 of the slide 30 so as not to inhibit motion of the slide 30.

As seen in FIG. 9, a recess 58 formed in a side of the upper arm 71 of the slide 30 to receive the upper lever arm of the cam 52 such that the upper arm 71 of the slide 30 engages the upper lever arm of the cam causing the cam 52 to rotate as the slide 30 is advanced within the casing 10, 12 toward the bolt 51. A narrowed portion 59 of the proximal end of the lower arm 72 is provided to accommodate rotation of the lower lever arm of the cam 51 as the slide arm 30 is advanced.

Figure 10:
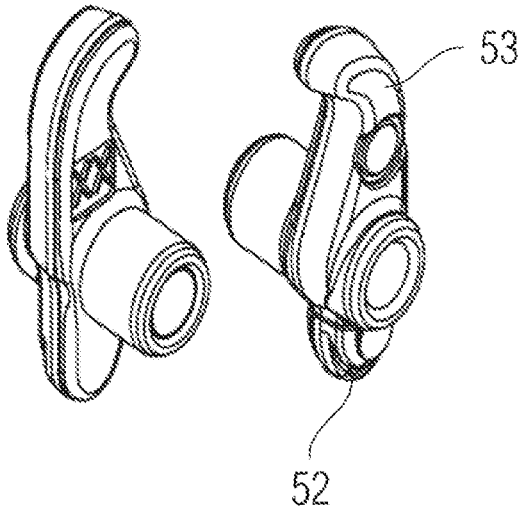
FIG. 10 is opposing perspective views of a cam of a latch according to the present invention.
Figure 11:
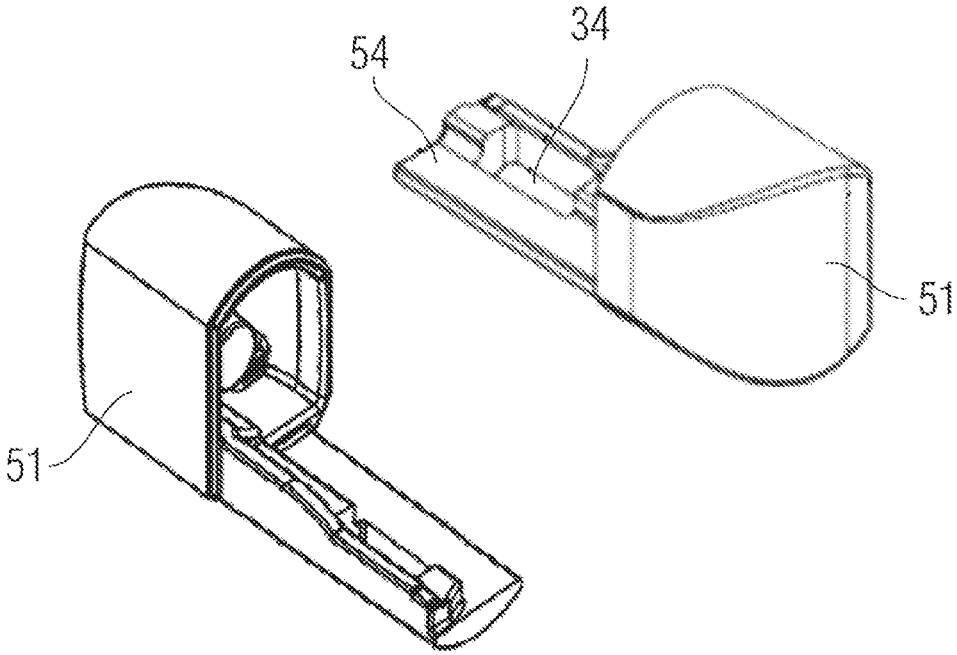
FIG. 11 is opposing perspective views of a bolt of a latch according to the present invention.

FIG. 10 are opposing perspective views of cam 52, and FIG. 11 are opposing perspective views of bolt 51. A lower lever arm 53 of cam 52 engages a recess 34 in the tail 54 of the bolt 51 such that rotation of the cam 52 urges the bolt 51 to slide into the casing 10, 12 and in the opposite direction of the slide 30. As seen in FIGS. 4-6, a spring 35 compressed between the advancing slide 30 and the bolt 51 as the bolt is retracted toward the slide 30 serves to return the slide to its original position and automatically extend the bolt 51 out of the outer casing 12 when rotation of the half-round spindle S is released. The narrowed portion 59 of the proximal end of the lower arm 72 is also held up above the inside surface of the outer casing 12 to permit the tail 54 of the bolt 51 to slide under the slide 30 as the slide advances forward and the bolt is retracted.

To install the above-described latch in a door in which the edge and face holes have been prepared at one of the industry standard backset distances thus requires the installer to simply grasp the inner casing 10 and pull (or push) it to cause it to slide out of (or into) the outer casing 12 to the proper, predetermined backset dimension. Pulling or pushing the inner casing 10 overcomes the detent resistance of the dimples 21 in the set of holes 20 allowing the inner casing 10 to slide. Once in the proper position the dimples 21 will again be engaged a set of holes 20 and thus retained in the desired position.

Once installed, as can be seen from comparing FIGS. 4 and 5 with FIG. 6, the latch mechanism operates in the same manner without regard to backset dimension save for the fact that the half-round spindle engages the first contact surfaces of the slide when set at the first, shorter backset distance, and engages the second contact surfaces on the slide extensions when set at the longer backset distance. Rotation of the half-round spindle S in either direction causes the half-round H to contact the upper or lower contact surface 88, 89 depending on the direction of rotation and selected backset driving the slide forward.

It should now be apparent that the above-described adjustable backset latch mechanism can accommodate multiple backset dimensions with minimal adjustment and/or specifically which can accommodate backsets of 2⅜ inches (60 mm) and 2¾inches (70 mm), is simple to adjust, and has a minimum of moving parts so as to be efficient and inexpensive to manufacture and reliable to operate.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims and may be used with a variety of materials and components. This application is therefore intended to cover any variations, uses, or adaptations of the invention using its general principles. Further, this application is intended to cover such departures from the present disclosure as come within known or customary practice in the art to which this invention pertains.

I claim:

1. A latch assembly for insertion into an edge of a door and adjustable for actuation by a spindle at either a first backset dimension or a second backset dimension, comprising a latch casing comprising an outer casing having a first end for alignment with said edge and a second end and defining a first axis there between;

an inner casing non-rotatably received within said outer casing and slideable along said axis, said inner casing having a transverse void there through substantially perpendicular to said first axis, said inner casing slideable between a first position in which said transverse void is operatively aligned at said first backset dimension and a second position in which said transverse void is operatively aligned at said second backset dimension; and a bolt assembly received within said latch casing and comprising a bolt slideable along said first axis between a first position in which said bolt extends outward past said first end of said latch casing and a second position in which said bolt is retained within said latch casing;

wherein said outer casing further comprises a dimple protruding from a surface thereof, and wherein said inner casing further comprises first and second recesses in a surface thereof, said dimple is configured to selectively receive said first recess to position said inner casing relative to said outer casing in the first backset dimension, and said dimple is configured to selectively receive said second recess to position said inner casing relative to said outer casing in the second backset dimension; and wherein movement between the first and second casings between the first and second backset dimensions is linear with no rotational movement between the first and second casings, nor adjustment of other components of the latch assembly.

2. The latch assembly of claim 1 wherein said first recess and said second recess are joined by a channel in said surface of said inner casing extending there between.

3. The latch assembly of claim 1 wherein said at least one recess is a hole.

4. The latch assembly of claim 1 further comprising a first stem void passing through said inner casing through which a door knob mounting stem may pass from one side of said door to another; and a second stem void passing through said outer casing and a third stem void passing through said outer casing substantially parallel to said second stem void through each of which a door knob mounting stem may pass from one side of said door to another;

wherein said first stem void is aligned with said second stem void when said inner casing is in said first position and is aligned with said third stem void when said inner casing is in said second position.

5. The latch assembly of claim 1 wherein said bolt assembly further comprises a cam rotatably mounted in said latch casing and engaged to said bolt; and a slide, said slide slideably received in said latch casing and engaged at a first end by said spindle and at a second end by said cam;

whereby said cam rotates to retract said bolt in response to said slide sliding within said latch casing and said slide slides within said latch casing in response to rotation of said spindle.

6. The latch assembly of claim 5 wherein said first end of said slide comprises at least a first contact surface for engagement with said spindle and a second contact surface for engagement with said spindle, said first contact surface positioned a distance along said axis from said second contact surface.

7. The latch assembly of claim 6 wherein said distance along said axis is equal to the difference between said first backset dimension and said second backset dimension.

8. The latch assembly of claim 6 wherein said first end of said slide further comprises a third contact surface positioned in alignment with said first contact surface along said axis, said first contact surface engaged by said spindle when said spindle is positioned at said first backset dimension and rotated in a first direction and said third contact surface engaged by said spindle when said spindle is positioned at said first backset dimension and rotated in a second direction.

9. The latch assembly of claim 8 wherein said first end of said slide further comprises a fourth contact surface positioned in alignment with said second contact surface along said axis, said second contact surface engaged by said spindle when said spindle is positioned at said second backset dimension and rotated in a first direction and said fourth contact surface engaged by said spindle when said spindle is positioned at said second backset dimension and rotated in a second direction.

10. The latch assembly of claim 5 further comprising a spring compressibly engaged between said slide and said bolt, said spring biasing said bolt into said first position.

11. A latch casing for insertion into an edge of a door, comprising a substantially tubular outer casing having a first axis, and at least one first indexing surface feature;

an inner casing non-rotatably received within said outer casing and slideable along said first axis, said inner casing having a transverse void there through substantially perpendicular to said first axis for permitting a spindle of a door knob to pass through said inner casing, and a plurality of second indexing surface features in cooperative alignment with said first indexing surface feature of said outer casing, said inner casing being linearly slideable inside said outer casing without rotation between a first position in which said transverse void is operatively aligned at said first backset dimension by said first indexing surface feature and one of said plurality of second indexing surface features, and a second position in which said transverse void is operatively aligned at said second backset dimension by said first indexing surface feature and another of said plurality of second indexing surface features.

12. The latch casing of claim 11, wherein said plurality of second indexing surface features comprise a plurality of recesses in a surface of said inner casing and wherein said at least one first indexing surface feature comprise a protrusion from a surface of said outer casing.

13. The casing of claim 12 wherein said plurality of recesses comprises a first recess and a second recess, said first recess and second recess aligned along a second axis parallel to said first axis.

14. The latch casing of claim 12 wherein said plurality of recesses comprise holes.

15. The latch casing of claim 11, wherein said inner casing further comprises first a pair of holes through said surface of said inner casing, said pair of holes aligned to define a first stem void through said inner casing through which a door knob mounting stem may pass from one side of said door to another.

16. The latch casing of claim 15, further comprising a second and a third pair of holes through said surface of said outer casing, said secondpair of holes aligned to define a second stem void and said third pair of holes aligned to define a third stem void through said outer casing through which a door knob mounting stem may pass from one side of said door to another;

wherein said first stem void is aligned with said second stem void when said inner casing is in said first position and is aligned with said third stem position when said inner casing is in said second position.

17. A latch assembly, comprising:

a latch casing as claimed in claim 11;

a cam rotatably mounted in said latch casing and engaged to said bolt; and a slide, said slide slideably received in said latch casing and engaged at a first end by said cam and at a second end by a spindle when said spindle is positioned at a first backset dimension and engaged by said spindle at a third end when said spindle is positioned at a second backset dimension;

whereby said cam rotates to retract said bolt in response to said slide sliding within said latch casing and said slide slides within said latch casing in response to rotation of said spindle at said first backset dimension or said second backset dimension.

18. A method of adjusting the backset dimension of a latch casing between a first backset dimension and a second backset dimension, comprising the steps of providing a substantially tubular outer latch casing having a first axis;

providing an inner latch casing non-rotatably received within said outer casing and slideable along said axis, and adjusting the backset dimension by sliding said inner latch casing within said outer latch casing along said first axis.

19. The method according to claim 18, wherein said inner casing has a transverse void there through substantially perpendicular to said axis for permitting a spindle of a door knob to pass through said inner casing, said step of adjusting the backset dimension further comprising sliding said inner casing between a first position in which said transverse void is operatively aligned at said first backset dimension and a second position in which said transverse void is operatively aligned at said second backset dimension.

20. The method according to claim 19, further comprising a step of providing a bolt assembly comprising a bolt slideable along said first axis and a slide operatively engaged to retract said bolt, said slide having a first end slideably received in said outer latch casing and a second end extending into said inner latch casing, said second end having a first contact surface engaged by said spindle when said spindle is situated in said transverse void and said inner casing is in said first position such that said transverse void is operatively positioned at said first backset dimension, and a second contact surface engaged by said spindle when said spindle is situated in said transverse void and said inner casing is in said second position such that said transverse void is operatively positioned at said second backset dimension; and said step of adjusting the backset dimension further comprising selecting a desired backset dimension and sliding said inner casing to the corresponding position.

21. The method of adjusting the backset dimension of a latch casing of claim 20 further comprising the steps of inserting said latch casing into a door; and inserting a spindle through said transverse void whereby said spindle engages said first contact surface or said second contact surface corresponding to the desired backset dimension.

22. A latch assembly having an adjustable backset, comprising:

a latch casing for insertion into an edge of a door, said latch casing further comprising a substantially tubular outer casing defined by one or more indexing surface features;

an inner casing received within said outer casing and slideable along said first axis, said inner casing having a transverse void there through substantially perpendicular to said first axis for permitting a spindle of a door knob to pass through said inner casing, and said inner casing being defined by one or more indexing surface features, said inner casing being slideable between a first position in which said transverse void is operatively aligned at said first backset dimension by said cooperating indexing surface features of the inner casing and outer casing, and a second position in which said transverse void is operatively aligned at said second backset dimension by said cooperating indexing surface features of the inner casing and outer casing;

a cam rotatably mounted in said latch casing and engaged to said bolt; and a slide slideably received in said latch casing and engaged at one end by said cam and at another end by a spindle;

whereby a backset dimension of said latch assembly may be adjusted by non-rotatably sliding said inner latch casing within said outer latch casing along said first axis into a position indexed by said cooperating indexing surface features of the inner casing and outer casing, without adjustment of any other components.

* * * * *